US011156402B2

(12) United States Patent
Benedetti et al.

(10) Patent No.: US 11,156,402 B2
(45) Date of Patent: Oct. 26, 2021

(54) APPARATUS AND METHOD FOR MELTING METAL MATERIAL

(71) Applicant: DANIELI & C. OFFICINE MECCANICHE S.P.A., Buttrio (IT)

(72) Inventors: Gianpietro Benedetti, Tricesimo (IT); Stefano Terlicher, Cividale del Friuli (IT); Federico Bianco, Muzzana del Turgnano (IT); Damiano Patrizio, Pagnacco (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 40 days.

(21) Appl. No.: 16/651,424

(22) PCT Filed: Sep. 28, 2018

(86) PCT No.: PCT/IT2018/050178

§ 371 (c)(1),
(2) Date: Mar. 27, 2020

(87) PCT Pub. No.: WO2019/064320

PCT Pub. Date: Apr. 4, 2019

(65) Prior Publication Data

US 2020/0284512 A1 Sep. 10, 2020

(30) Foreign Application Priority Data

Sep. 29, 2017 (IT) ..... 102017000109681

(51) Int. Cl.
*H05B 7/10* (2006.01)
*F27B 3/08* (2006.01)
(Continued)

(52) U.S. Cl.
CPC ..... *F27B 3/085* (2013.01); *F27B 3/183* (2013.01); *F27B 3/28* (2013.01); *F27D 11/10* (2013.01)

(58) Field of Classification Search
CPC ..... F27D 11/00; F27D 11/06; F27D 11/08; F27D 11/10; H05B 7/005; H05B 7/085; H05B 7/10; H05B 7/102; H05B 7/11; H05B 7/144; H05B 7/148; H05B 7/20; F27B 3/065; F27B 3/085; F27B 3/12;
(Continued)

(56) References Cited

U.S. PATENT DOCUMENTS

| | | | |
|---|---|---|---|
| 1,127,475 | A | 2/1915 | Marshall |
| 3,665,081 | A | 5/1972 | Paton et al. |

(Continued)

FOREIGN PATENT DOCUMENTS

| | | |
|---|---|---|
| CN | 85104161 | 3/1987 |
| DE | 973715 | 5/1960 |
| WO | 2014174463 | 10/2014 |

OTHER PUBLICATIONS

International Search Report filed in PCT/IT2018/050178 dated Jul. 12, 2018.

*Primary Examiner* — Hung D Nguyen
(74) *Attorney, Agent, or Firm* — Rankin, Hill & Clark LLP

(57) ABSTRACT

Apparatus for melting metal material comprising a container for metal material, by way of example, but not limited to, metal scrap, DRI, cast iron, supplied in an electric arc-type melting furnace, and a plurality of electrodes to melt the metal material, which can be inserted in said container.

17 Claims, 2 Drawing Sheets

(51) Int. Cl.
*F27B 3/18* (2006.01)
*F27B 3/28* (2006.01)
*F27D 11/10* (2006.01)

(58) Field of Classification Search
CPC .. F27B 3/18; F27B 3/183; F27B 3/186; F27B 3/19; F27B 3/205; F27B 3/28
USPC ..... 373/60, 62, 63, 67, 69, 70, 71, 73, 79, 373/81, 88, 90, 94, 101, 102, 104, 105, 373/106, 108
See application file for complete search history.

(56) References Cited

U.S. PATENT DOCUMENTS 3,751,572 A * 8/1973 Paton ..... C22B 9/18 373/48
3,772,449 A * 11/1973 Fischer ..... H05B 3/0023 373/47
3,790,691 A * 2/1974 Paton ..... H05B 7/005 373/47
3,867,561 A * 2/1975 Paton ..... H05B 7/102 373/48
4,406,008 A 9/1983 Koenig

* cited by examiner

APPARATUS AND METHOD FOR MELTING METAL MATERIAL

FIELD OF THE INVENTION

The present invention concerns an apparatus for melting metal material, by way of example, but not only, metal scrap, DRI, cast iron, supplied in an electric arc-type melting furnace.

The invention also concerns a method for melting the metal material.

BACKGROUND OF THE INVENTION

Various types of apparatuses are known for melting metal material, for example, but not only, scrap. Examples of melting apparatuses are disclosed, for example, in U.S. Pat. Nos. 4,406,008, 3,665,081, DE-C-973.715, U.S. Pat. No. 1,127,475, CN-A-85.104.161, and WO-A-2014/174463.

In particular, electric arc furnaces are known, in which the electric arc between one or more electrodes and the metal material contained in a container, or shell, melts the metal material.

In the field of electric arc furnaces, the use of three electrodes connected to a three-phase power unit is currently common, in which each phase is connected to a respective electrode.

The electrodes are normally disposed according to a triangle pattern and are located in a substantially central zone of the container so that the electric arcs which are generated between the electrodes melt the metal material.

It is also known that the temperature of the molten metal in the container during melting is not uniform, so that there are zones in which the molten metal tends to cool, for example due to the proximity to the solid mass present in the container, and zones in which the molten metal is overheated. It often happens that some parts of the furnace, which are in front of the phases or the electrodes, overheat and cause so-called hot spots, which damage the refractory.

The superheated molten metal is subject to convective phenomena which not only do not allow optimal control of the quality of the metal but also increase wear on the walls, that is, the refractories of the container with consequent increase in maintenance interventions, and related additional costs.

These phenomena are generally due to an uneven distribution of the thermal energy, supplied by the electric arcs.

In these electric furnaces the material is substantially continuously discharged into the container, and in proximity to a wall of the latter.

The zones located in proximity to the discharge zone of the metal material are generally colder than the zones of the container opposite the discharge zone. This also happens in the case of discontinuous loads, carried out by means of basket loading, which do not guarantee uniform distribution of the material to be melted in the furnace.

To counteract the non-uniformity of the temperature of the metal material it is also known to have two of the three electrodes aligned with each other and directly facing toward the discharge zone of the container. The third electrode is instead directed toward the hot zone of the container and causes the overheating of the molten metal as described above.

Current solutions imply difficulties in controlling the melting cycle of the molten metal and the processes of refining the latter.

Furthermore, the difficulties of making the temperatures of the molten metal uniform and controlling them better require an increase in the energy for melting.

Another disadvantage of the state of the art is the long duration of each melting cycle.

It is therefore a purpose of the invention to provide a melting apparatus, and to perfect a corresponding method, which allows to reduce the wear phenomena inside the melting container with consequent reduction of the required maintenance interventions.

It is also a purpose of the invention to provide a melting apparatus which allows to reduce the amount of electrical energy required.

It is another purpose of the present invention to provide a melting method which allows to control the electric arcs during the melting processes.

It is also a purpose of the present invention to distribute the energy emitted by the electrodes effectively at the desired points, for any type of furnace.

It is also a purpose to obtain a more uniform melting process both in terms of melting of the solid metal and also in terms of homogeneity of the temperature of the molten metal.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, an apparatus for melting metal material according to the invention comprises at least a container to contain the metal material to be melted, a loading device associated with a lateral wall of the container in order to load the metal material substantially continuously into the container, and at least two pairs of electrodes to melt the metal material. Each pair of electrodes is connected to a respective electric power unit. Each power unit is configured to generate an electric arc between the electrodes of the respective pair that is powered.

The present invention also provides that the electrodes can be at least partly inserted into the container and are reciprocally disposed according to a pattern at the tops of a polygon.

According to a further aspect of the present invention, each pair of electrodes comprises a first electrode and a second electrode. The first electrodes are located at the tops of a first side of the polygon and the second electrodes are located at the tops of a second side of said polygon. The first side and the second side define respectively the smaller base and the larger base of a trapezoid. Moreover, the distance between the first side and said loading device is lower than the distance between the second side and the loading device.

The particular disposition of the electrodes allows to distribute, during the melting process, the thermal energy toward the molten metal in an optimized manner, reducing the non-uniformity of temperature of the molten metal present in the container.

For example, during the loading of the metal material into the container, a cool zone is generated in correspondence of the discharged material. The particular disposition of the electrodes, combined with a control of the electric energy provided to each pair of electrodes, allows to increase the heating power in correspondence of the cool zone, in order to obtain an equal distribution of the temperature in the metal bath. In this way not only the thermal energy is optimized in correspondence of the cool zone, but also a reduction of the wear of the container walls can be obtained, since a reduction of supplied energy can be regulated in the hot zone of the metal bath, in which the metal material is already melted. The reduction of the supplied energy in the hot zone of the metal bath allows a reduction of the thermal convective flux and, therefore, a reduction of wear of the walls of the container.

In accordance with some solutions of the invention, it is advantageous to provide that the electrical energy of each pair of electrodes is distinct and adjustable independently with respect to the energy of the other pair of electrodes. This allows to optimize the control of the functioning of the electrodes, their distribution of power and their effect during the melting process.

In accordance with a possible embodiment, the polygon has a quadrilateral shape, in which the electrodes of the pairs are disposed in each top. This embodiment allows to suitably distance the electrodes from each other.

According to a variant, the polygon has a shape similar to a trapezium.

According to another variant, the two sides connecting two electrodes of each pair have a desired reciprocal angle.

According to a variant, the two sides connecting two electrodes of each pair are facing and disposed angled at said reciprocal angle.

According to another variant, of the two pairs of electrodes, the two electrodes nearest each pair face toward the loading device of the material.

According to another variant, the two electrodes facing toward the loading device of the material cooperate with oxygen lances or other auxiliary devices to supply thermal energy.

According to a variant, the two electrodes which make up one side of the trapezium face the removal or tapping zone of the molten metal.

According to a variant, at least one electrode that makes up one pair is movable in the plane x, y, median and orthogonal to the vertical of the container, according to operational needs.

The fact that pairs of electrodes are provided, electrically powered independently of one another, allows to independently manage the lengths of the arcs, thus favoring, if necessary, specific zones of the metal material.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
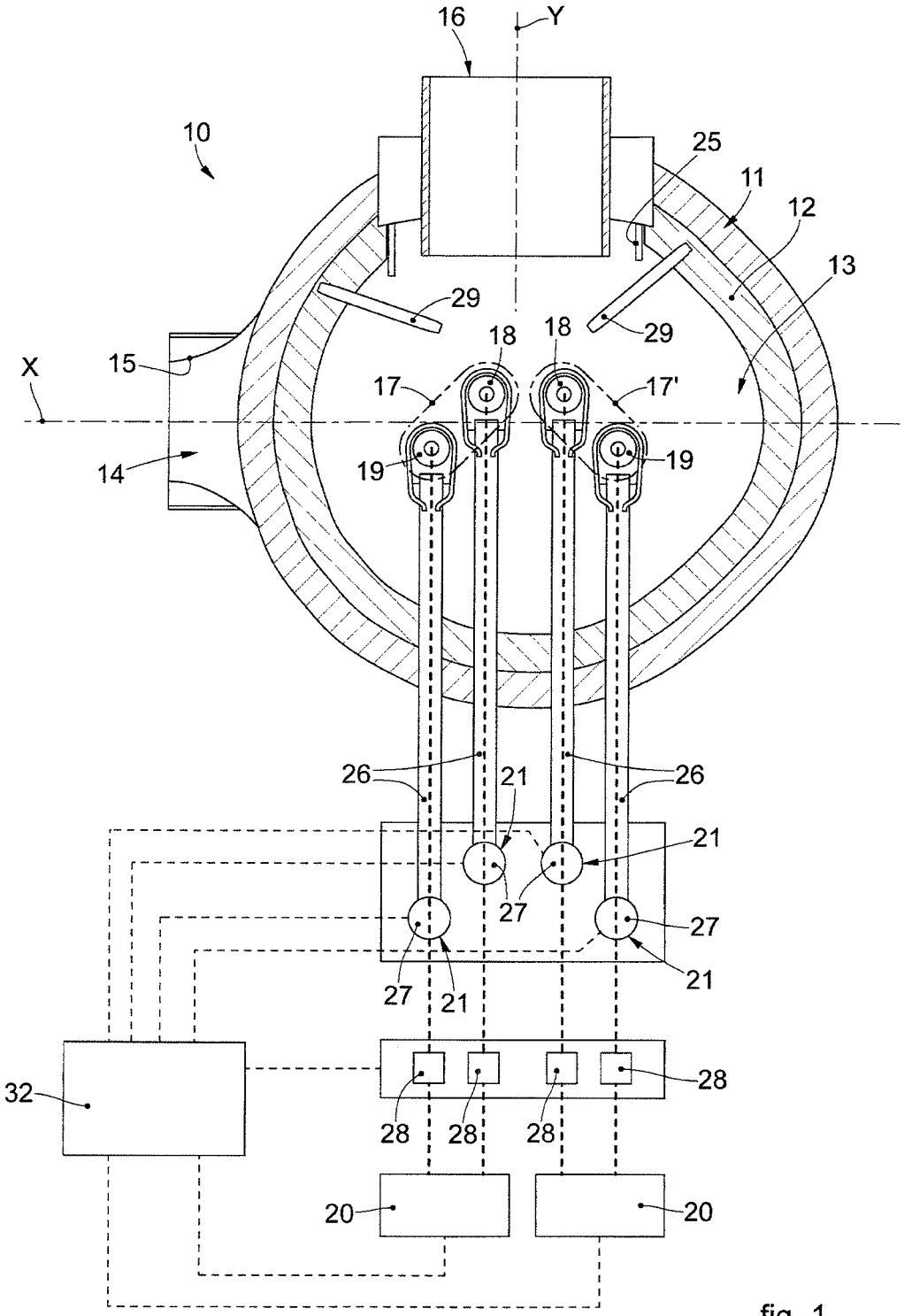
FIG. 1 is a schematic plan view of a melting apparatus for metal material in accordance with the present invention.
Figure 2:
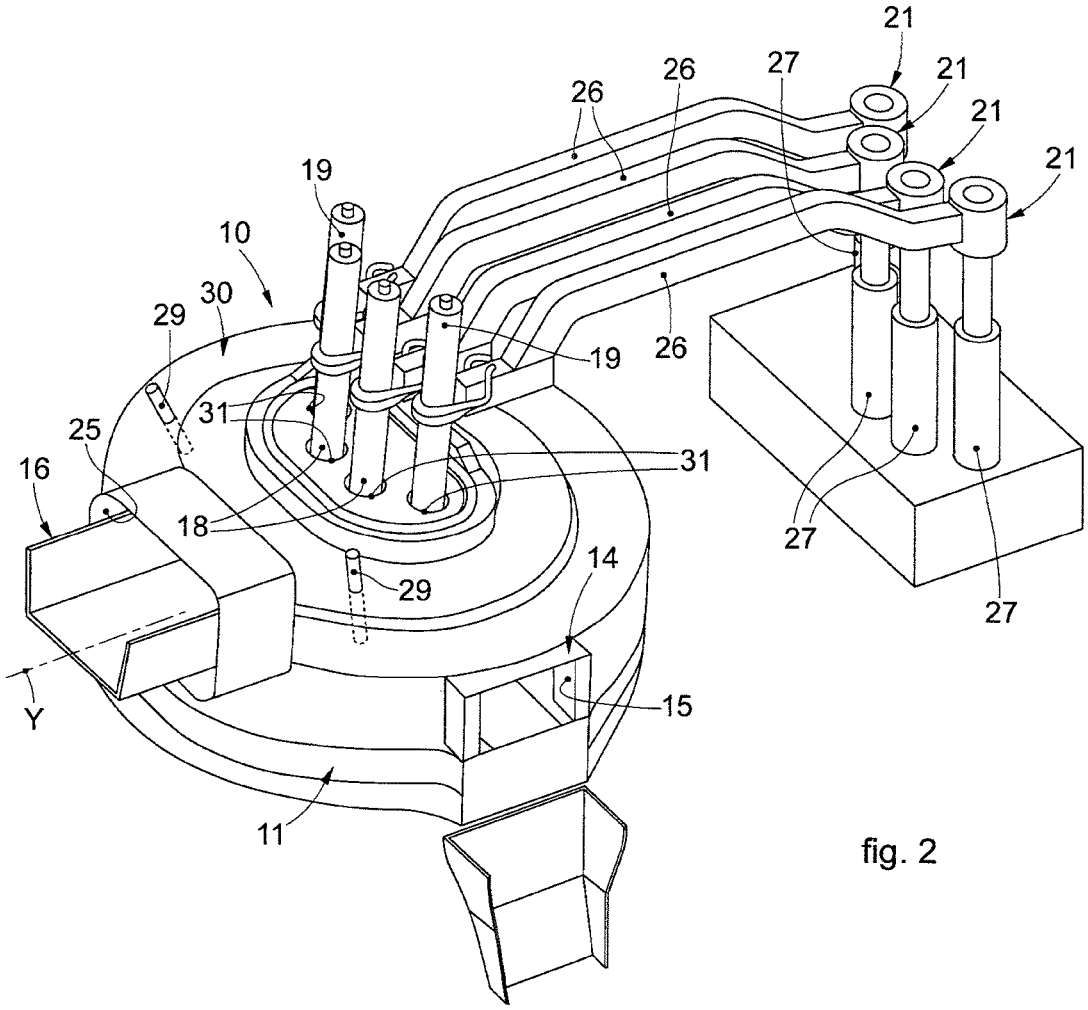
FIG. 2 is a schematic prospective view of FIG. 2.

Embodiments of the present invention concern a melting apparatus which is indicated in the drawings in its entirety by the reference number 10 and is used to melt metal material.

The melting apparatus 10 comprises a container 11, also called a shell, in which the metal material is introduced and subsequently melted.

The container 11 is normally lined with a lining layer 12, such as a refractory material suitable to resist the melting temperatures.

The container 11 can have a normally ellipsoidal cross-section shape, in this case, egg-shaped.

The container 11 is provided with a removal zone 13 in correspondence with which the molten metal is removed.

The removal zone 13 can be provided on the periphery and in proximity to the walls of the container 11.

The container 11 is also normally provided with a de-slagging zone 14 in correspondence with which the slag generated during the melting process is discharged.

The de-slagging zone 14 can be located in a preferential zone, for example opposite the removal zone 13.

The de-slagging zone 14 can comprise a de-slagging aperture 15 made in correspondence with a wall of the container 11.

Normally, the de-slagging zone 14 and the removal zone 13 can be aligned along a common longitudinal axis X which can identify, on the plane orthogonal to the vertical axis of the container 11, a median axis of the container 11.

According to a possible solution, the container 11 can be moved, for example, rotated around an axis orthogonal to the longitudinal axis X. The container 11 can, in fact, be rotated around an axis, downward and on the side of the de-slagging zone 14, to discharge the slag generated during melting, or in the opposite direction, toward the removal zone 13, to facilitate the discharge operations of the molten metal, called tapping steps.

If the container 11 has an egg-shaped cross section, the removal zone 13 and the de-slagging zone 14 are positioned respectively at the tip of the egg, that is, where the curvature of the container 11 is narrower or wider.

The melting apparatus 10 normally comprises a loading device 16 provided to load the metal material into the container 11.

According to possible solutions, the loading device 16 can be defined, at least partly, by a loading aperture 25 associated with the container 11.

In accordance with possible embodiments, the loading device 16 can be configured to load the metal material into the container 11 substantially continuously, for example by means of a conveyor.

In accordance with possible solutions, the loading device 16 can comprise a conveyor suitable to feed the metal material substantially continuously.

The loading device 16 can also be selected from a group comprising a conveyor belt, a vibrating channel, an alternating movement mechanism.

According to possible solutions, the loading device 16 can be positioned in correspondence with a lateral wall of the container 11 itself, for example in a zone comprised between the removal zone 13 and the de-slagging zone 14.

According to a possible solution, the loading device 16 identifies a loading axis Y normally located substantially orthogonal to the longitudinal axis X.

The longitudinal axis X identifies, in the container 11, a first region facing toward the loading device 16 which comprises the cold zone of the molten metal, and a second region, opposite the first, which identifies a hot zone of the molten metal.

According to one aspect of the present invention, the melting apparatus 10 comprises at least two pairs 17 and 17' of electrodes 18, 19.

According to a further embodiment, the melting apparatus 10 comprises only two pairs 17 and 17' of electrodes 18, 19.

The electrodes 18, 19 can be located with their respective axis substantially parallel to each other and, during use, incident toward the bottom wall of the container 11.

In accordance with possible solutions, each electrode 18, 19 is associated with a respective movement device 21 intended to move the respective electrode 18, 19 with respect to the container 11 and with respect to the other electrodes 18, 19.

In particular, by adjusting the reciprocal distance of the ends of the electrodes 18, 19 with respect to the metal material, it is possible to adjust the length of the arc and therefore also the quantity of thermal energy that the latter transfers toward the metal material.

More in particular, the greater the distance of the ends of the electrodes 18, 19 from the metal material, the greater the intensity of the arc and therefore the melting thermal energy transferred to the metal material.

Each movement device 21 can be configured to also modify the reciprocal distance between the electrodes 18, 19 as described below.

In accordance with some solutions of the invention, the movement device 21 can comprise a support arm 26 provided to support, for example at one of its ends, the respective electrode 18, 19, and at least one actuator 27, for example linear, provided to move the support arm 26 in a direction substantially parallel to the oblong development of the electrode 18, 19.

It is in the spirit of the invention to move the electrode 18, 19 nearer to/away from the bottom of the container 11, thus allowing to adjust the length of the electric arc and therefore of the electric power.

According to a variant embodiment, each movement device 21 is autonomous and is configured to move the respective electrode 18, 19 in a desired direction orthogonal to its axis. This allows to position the electrodes in the plane x y, linearly or according to a desired path, for example arcuate, to define the reciprocal distance between the electrodes.

In a preferential variant, the electrodes can be moved during the melting process.

The movement of the electrodes 18, 19 can be conditioned and defined by the sizes of the respective support arms 26.

By way of example only, the electrode 18, 19 can be moved on the plane x, y along a path comprised between 50 mm and 200 mm to make adjustments to the power of the arc delivered.

By adjusting the reciprocal distance of the ends of the electrodes 18, 19 with respect to the metal material, it is possible to adjust the length of the arc and therefore also the quantity of thermal energy transferred to the metal material.

Each movement device 21 can be configured to also modify the reciprocal distance of each electrode 18, 19 with respect to the metal material.

In accordance with some solutions, each pair 17 and 17' of electrodes 18, 19 is connected to a respective power unit 21.

According to possible solutions, the power units 20 of each pair 17 and 17' can be separate and adjustable independently from each another. This allows to precisely control the functioning of the electrodes 18, 19 and therefore the distribution of thermal energy toward the metal material. Furthermore, if one of the power units 20 malfunctions, it is possible to proceed and end the melting process with the other pair 17 and 17' of electrodes 18, 19.

According to a possible solution, the power units 20 are each configured to supply respective pair 17 and 17' of electrodes 18, 19 with a mono-phase alternating current.

In particular it is possible to provide that the power units 20 are configured to regulate the frequency of electrical supply of the electrodes 18, 19.

In accordance with a possible solution, it can be provided that, at least in the case of two power units 20, they are configured to provide respective electrical energies which are reciprocally out-of-phase with respect to each other, for example by a desired phase shift angle, for example 180°.

According to a possible variant embodiment, the power units 20 are configured to supply each respective pair 17 and 17' of electrodes 18, 19 with a direct current.

In accordance with possible solutions, the power units 20 can comprise at least one of either a transformer, an inverter converting from direct current to alternating current, an inverter converting from alternating current to direct current, an intermediate circuit or a DC link, or a possible combination of the above.

According to a possible solution of the invention, the power units 20 are electrically connected to an electric supply network.

Detection devices 28 can be associated with the power units 20, or between the electrodes 18, 19 and the power units 20. Each detection device 28 is configured to detect electrical functioning parameters, for example at least one of either the voltage or current supplying each electrode 18, 19.

According to the present invention, the electrodes 18, 19 are disposed in a pattern at the tops of a polygon 22.

In accordance with advantageous solutions, the polygon 22 can have a number of even sides.

According to other embodiments, the polygon 22 can be defined by a quadrilateral.

According to a first variant, said disposition provides that the electric arcs between the first electrode 18 and the second electrode 19 of the first pair 17 are parallel or angled but not intersecting.

According to a second variant, not shown, said disposition can provide that the electric arcs between the first electrode 18 and the second electrode 19 of the first pair 17 are crossed.

The polygon 22 can be located in a substantially central zone of the container 11.

In accordance with possible solutions, each pair 17 and 17' of electrodes comprises a first electrode 18, and a second electrode 19.

The first electrodes 18 of at least two pairs 17 and 17' are located at the tops of a first side 23 of the polygon 22, and the second electrodes 19 of at least two pairs 17 and 17' are located at the tops of a second side 24 of the polygon 22.

This disposition of the electrodes 18, 19 allows to prevent the electric arcs generated by the electrodes from disturbing each other, causing a reduction in the heating efficiency.

According to a possible solution of the invention, the polygon 22 has a trapezium shape. This disposition allows the electrodes 18, defining the smaller base of the trapezium, to generate a spatially concentrated heating of the metal material, whereas the electrodes 19 defining the larger base generate a spatially distributed heating in the at least partly melted metal material.

According to one aspect of the present invention, the first side 23 and the second side 24 are connected to each other, at the tops, by connection sides 33, 34 which define the reciprocal distance between the electrodes 18, 19, of a pair 17 and 17'.

The length of the connection sides 33, 34 can also be adjusted, also independently of each other, by acting on the movement devices 21.

In the same way, the reciprocal angulation of the connection sides 33, 34 can also be adjusted by means of the movement devices 21.

According to a possible solution of the invention, the first side 23 and the second side 24 define respectively the smaller base and the larger base of the trapezium.

According to a possible solution, the first side 23 of the polygon 22 is distanced from the loading device 16 by a first distance D1 while the second side 24 of the polygon 22 is distanced from the loading device 16 by a second distance D2 which is greater than the first distance D1.

Here and hereafter in the description, the distance is determined along the straight line orthogonal to the side considered.

According to a variant, the first side 23 directly faces the loading device 16 and substantially parallel to a discharge edge of the latter.

The first side 23 and the second side 24 can be positioned substantially parallel to each other.

Moreover, the first side 23 and the second side 24 can be positioned substantially parallel to the longitudinal axis X.

According to a variant, the first side 23 and the second side 24 can be positioned with a desired angle.

According to a possible solution, the first distance D1 is determined in such a way as to prevent the metal material discharged by the loading device 16 from interfering directly with the first electrodes 18, damaging them.

According to possible solutions, the first distance D1 is at least one meter.

According to possible solutions, the first distance D1 is between 0.15 and 0.4 times, preferably between 0.2 and 0.3 times, the width of the container 11, determined parallel to the first distance D1.

In accordance with a solution embodiment, the polygon 22 is positioned in the container 11 so that it intercepts the longitudinal axis X, in order to obtain a desired positioning of the electrodes 18, 19 in the container 11.

In accordance with possible embodiments of the present invention, the oblique sides of the trapezium can be inclined with respect to the second side 24 by an angle $\alpha$ comprised between 20° and 90°, preferably between 25° and 50°.

This angle allows to define an optimized positioning of the electrodes 18, 19, in order to make electrical arcs generated according to requirements and non-interfering.

In accordance with possible solutions, the movement devices 21 can be configured to also modify the reciprocal positioning of the electrodes 18, 19, or their reciprocal distance when faced with particular needs to optimize the melting process and based on the data detected by the detection devices 28.

According to possible solutions of the present invention, the melting apparatus 10 also comprises auxiliary devices 29 configured to supply thermal energy to the material contained in the container 11.

The auxiliary devices 29 can comprise at least one of either burners, gas injection lances, devices for introducing additives.

In accordance with possible solutions, the auxiliary devices 29 can be positioned on the sides of the loading device 16.

According to one aspect of the present invention, the melting apparatus 10 can comprise a covering body 30 associated with the container 11 to at least partly close its upper aperture, so as to provide through apertures 31 disposed according to a pattern coordinated with the positioning pattern of the electrodes 18, 19, and possibly associated with the removal of the fumes that are generated during the melting process.

In particular, the through apertures 31 can also be obtained according to a pattern at the top of a polygon, analogous to the polygon 22 as defined above.

In accordance with other embodiments, the apparatus 10 according to the present invention comprises a control and command unit 32 connected at least to the power units 20 in order to manage and adjust independently from each other the supply electric power modes of each of the pairs 17 and 17' of electrodes 18, 19. The control and command unit 32 manages the supply of each pair of electrodes 18, 19.

According to possible solutions, the control and command unit 32 can also be connected to the movement devices 21 and to the detection devices 28 in order to adjust the position of the electrodes 18, 19, also depending on the electrical parameters detected by the detection devices 28.

Embodiments of the present invention also concern a melting method implemented in a melting apparatus 10 as described above.

In particular, the melting method comprises at least the insertion of the metal material into the container 11. The insertion of the material can take place substantially continuously, during the melting process, as described above, or in discontinuous mode, for example by using loading baskets.

It can be provided that detectors of the solid metal material can be associated with the apparatus 10, such as ultrasound sensors, radar sensors, or thermal sensors, panels sensitive to high temperatures, able to detect the temperature and/or consistency of the material contained in the container 11. Depending on the detected data, it is possible to manage the positioning of the electrodes 18, 19.

The method then provides a melting step during which a plurality of electrodes 18, 19, positioned in the container 11, generate respective electric arcs to melt the metal material.

The method according to the invention provides that the number of electrodes is an even number and that pairs 17 and 17' of electrodes 18, 19 are each supplied by a respective power unit 20.

Moreover, the electrodes 18, 19 are at least partly inserted into the container 11, disposing them reciprocally according to a pattern at the top of the polygon 22.

According to a possible solution, during melting, each pair 17, 17' of electrodes 18, 19 can adjust the thermal power delivered to the metal material.

During the melting step of the metal material, a first sub-step to feed the metal material to the container 11 is provided, substantially continuous, and a subsequent second sub-step, which interrupts the feed of the metal material, during which the material contained in the container 11 is further heated.

The first feeding sub-step can involve a time comprised between 80% and 90% of the melting time, understood as the time comprised between the activation and the deactivation of the electric power supply to the electrodes.

According to possible solutions, it can be provided that at least during the first feeding sub-step, the first electrodes 18 generate a heating action greater than that generated by the second electrodes 19.

In particular, this difference in heating can be obtained by a different distance of the first electrodes 18 and the second electrodes 19 from the metal material.

Figure 3:
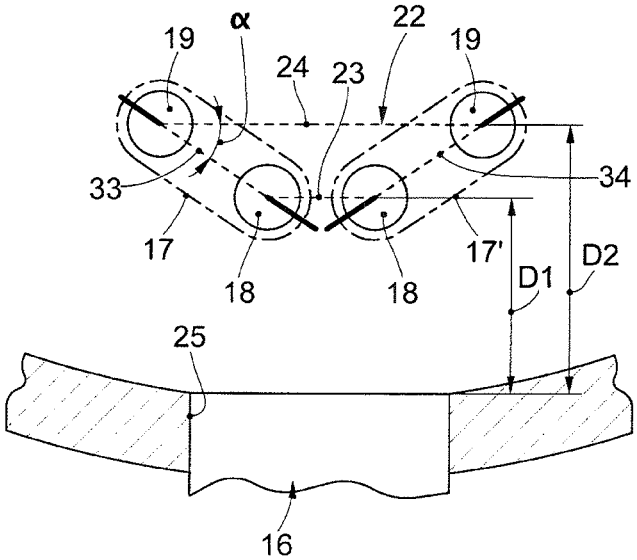
FIG. 3 is a schematic illustration of the disposition of the electrodes of a melting apparatus in accordance with the present invention.

By way of example only, it can be provided that at least during said first feeding sub-step, the first electrodes 18 are kept distanced from the metal material by a distance greater than that of the second electrodes 19. This allows the first electrodes 18 to generate electric arcs (shown in FIG. 3 in bold) with a greater length than those generated by the second electrodes 19.

The different distance of the electrodes 18, 19 from the metal material, combined with the particular positioning of the electrodes 18, 19 in the container 11, allows to increase the heating action toward the zone facing the loading device 16, that is, the region where the temperature is lowest, while it allows to exert a more distributed and uniform heating in the opposite and hotter region where the metal material has already been melted.

According to possible solutions, it can be provided that at least during the first feeding sub-step, the electrodes 18, 19 are moved by the respective movement devices 21 so that the ratio between the voltage detected at the first electrode 18 and that detected the second electrode 19 is comprised between 1 and 2, preferably between 1.2 and 1.7.

By suitably adjusting the position of the electrodes 19 it is therefore possible to adjust the heating action of the metal material present in the container 11, distributing the thermal energy in an optimized manner toward the zones where a greater heat contribution is required.

This allows to drastically reduce the phenomena of wear on the walls of the container 11 and to suitably control the temperature of the molten metal.

According to possible solutions of the method, during the second sub-step when the feed of the metal material is interrupted, the first electrodes 18 generate a heating action substantially equal to that generated by the second electrodes 19.

During the second sub-step when the feed of the metal material is interrupted, it is provided to position the first electrodes 18, using the movement devices 21, distanced from the metal material by a distance substantially equal to that of the second electrodes 19. This allows the electrodes 18, 19 to generate electrical arcs of substantially equal lengths and therefore to obtain a uniform heating action.

During the second sub-step when the feed of the metal material is interrupted, in fact, the metal material contained in the container 11 is completely or almost completely melted, and the electrodes are used to ensure a uniform heating of the molten metal bath. During the second sub-step, processes to refine the composition of the metal material or of the slag generated by the melting can be started, in a substantially known manner.

After the melting step, it is possible to provide the subsequent removal, or tapping, of the metal material from the container 11. During the removal operation it is possible to provide that the pair 17 and 17' of electrodes 18, 19 located toward the removal zone 13 is kept active in order to continue heating the molten metal, while the pair 17 and 17' of electrodes 18, 19 located toward the de-slagging zone 14 is deactivated and at least partly removed from the container 11 to prevent possible interference with the rotation of the latter.

It is clear that modifications and/or additions of parts can be made to the apparatus 10 and method as described heretofore, without departing from the field and scope of the present invention.

It is also clear that, although the present invention has been described with reference to some specific examples, a person of skill in the art shall certainly be able to achieve many other equivalent forms of apparatus 10 and method, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. An apparatus for melting metal material comprising a container to contain the metal material to be melted, a loading device associated with a lateral wall of said container in order to load said metal material substantially continuously into the container, and at least two pairs of electrodes to melt said metal material, each pair of electrodes being connected to a respective power unit, and said electrodes being inserted at least partly into said container, and being disposed in a pattern at the respective tops of a polygon, each pair of electrodes comprises a first electrode and a second electrode, said that electrodes are located at tops of a first side of said polygon and said second electrodes are located at tops of a second side of said polygon, said first side and said second side defining respectively a smaller base and a larger base of a trapezoid, and in that a distance between said first side and said loading device is less than a distance between said second side and said loading device.

2. The apparatus as in claim 1, further comprising a control and command unit connected at least to said power units to manage and regulate, in an independent manner, electric power modes of said pairs of electrodes.

3. The apparatus as in claim 2, wherein said first side and said second side are connected to each other, at the tops, by connection sides, said connection sides defining a positioning and reciprocal distance of the electrodes of a pair.

4. The apparatus as in claim 3, wherein said connection sides have a length and/or positioning that can be adjusted by movement devices.

5. The apparatus as in claim 3, wherein the angle between said connection sides can be adjusted by movement devices.

6. The apparatus as in claim 1, wherein said power units are each configured to supply respective pairs of electrodes with a mono-phase alternating current.

7. The apparatus as in claim 1, wherein said power units are configured to regulate the frequency of electrical supply of the electrodes.

8. The apparatus as in claim 1, wherein two power units are configured to provide respective electrical energies which are reciprocally out-of-phase with respect to each other.

9. The apparatus as in claim 1, wherein each electrode is associated with a respective movement device to move the respective electrode in a direction parallel to its axis, and in order to vary the melting power of said pairs of electrodes during the melting steps.

10. The apparatus as in claim 1, wherein each electrode is associated with a movement device to move the respective electrode in a direction transverse to its axis, during the different steps of the melting process.

11. A melting method comprising inserting, substantially continuously, metal material into a container with a loading device associated with a lateral wall of said container, and melting of the metal material by at least two pairs of electrodes, said pairs of said electrodes being electrically powered each by a respective power unit, and said electrodes being at least partly inserted into said container, disposing said electrodes reciprocally in a pattern at tops of a polygon, wherein each pair of said electrodes comprises a first electrode and a second electrode, in that said first electrodes are located at tops of a first side of said polygon and said second electrodes are located at tops of a second side of said polygon said first side and said second side defining respectively a smaller base and a larger base of a trapezoid, and in that said metal material is inserted into said container in correspondence with said lateral wall of said container facing toward said first side of said polygon.

12. The melting method as in claim 11, wherein each pair of electrodes is connected to a respective power unit, and a control and command unit, connected at least to said power units, manages and regulates, in an independent manner, the electric power modes of said pairs of electrodes.

13. The melting method as in claim 11, wherein during the melting step a first sub-step is provided of feeding, substantially continuously, the metal material into said container, and a subsequent second sub-step of interrupting the feed of the metal material and during which the material contained in the container is further heated.

14. The melting method as in claim 13, wherein at least during said first feeding sub-step, said first electrodes generate a heating action greater than that generated by said second electrodes.

15. The melting method as in claim 14, wherein the difference in heating is obtained by a different distance of the first electrodes and the second electrodes from the metal material.

16. The melting method as in claim 13, wherein during said second step of interrupting the feed of the metal material, said first electrodes generate a heating action substantially equal to that generated by said second electrodes.

17. The melting method as in claim 13, wherein said first feeding sub-step involves a time comprised between 80% and 90% of the melting time, understood as the time comprised between the activation and deactivation of the electric power to the electrodes.

* * * * *